United States Patent [19]

Beckrot et al.

[11] Patent Number: 4,950,959

[45] Date of Patent: Aug. 21, 1990

[54] CASSETTE LIGHT, POWERING UNIT THEREFORE, MULTI-DYNAMIC SMART MAGNETIC STRUCTURE AND METHOD

[75] Inventors: Anders V. Beckrot, Laguna Beach; James C. Helling, Newport Beach; Scott V. Murray, Huntington Beach, all of Calif.

[73] Assignee: LumiTech International, L.P., New York, N.Y.

[21] Appl. No.: 318,703

[22] Filed: Mar. 3, 1989

Related U.S. Application Data

[63] Continuation-in-part of Ser. No. 206,336, Jun. 13, 1988, which is a continuation-in-part of Ser. No. 131,752, Dec. 11, 1987, which is a continuation-in-part of Ser. No. 891,263, Jul. 26, 1986, Pat. No. 4,751,434.

[51] Int. Cl.[5] ..... H05B 37/02; H05B 41/16; H05B 41/24; H05B 37/04

[52] U.S. Cl. ..... 315/219; 315/DIG. 4; 315/DIG. 7; 315/278

[58] Field of Search ..... 362/217, 260, 148, 262, 362/265; 315/209 R, 219, 220, DIG. 7, DIG. 4, 278

[56] References Cited

U.S. PATENT DOCUMENTS

| | | | |
|---|---|---|---|
| 3,300,633 | 1/1967 | Grimes | 362/263 |
| 3,395,301 | 7/1968 | Iannelli | 362/263 |
| 3,697,743 | 10/1972 | Eargle | 362/260 |
| 4,184,194 | 1/1980 | Shofu | 362/260 |
| 4,404,619 | 9/1983 | Ferguson | 362/222 |
| 4,602,448 | 7/1986 | Grove | 362/260 |
| 4,751,434 | 6/1988 | Helling et al. | 315/183 |
| 4,809,142 | 2/1989 | Auerbach | 362/147 |

*Primary Examiner*—Eugene R. LaRoche
*Assistant Examiner*—Michael B. Shingleton
*Attorney, Agent, or Firm*—Willian Brinks Olds Hofer Gilson & Lione

[57] ABSTRACT

A cassette light retrofit adapted to be received in a housing portion of an existing lighting fixture from which the light tubes and door frame with diffuser have been removed comprises an open cassette enclosure having a door frame and diffuser closing the enclosure; a lightable tubing array in the cassette enclosure; a power converter in the enclosure connected to energize the lightable array; and, said cassette door frame being attachable to the fixture housing portion to replace said fixture door frame with the cassette enclosure being in said housing. The power converter uses 8 windings with isolation to improve the tracking efficiency of the sensing windings for accurate high frequency power application for the load. Also, an A.C. winding permits dimming of the lamp load by filling in chunks of voltage deleted by the dimmer.

7 Claims, 13 Drawing Sheets

CASSETTE LIGHT, POWERING UNIT THEREFORE, MULTI-DYNAMIC SMART MAGNETIC STRUCTURE AND METHOD

This is a continuation-in-part of U.S. patent application Ser. No. 206,336 entitled "Self-Illuminated Sealed Cool Light Display and Method" filed on June 13, 1988, which is a continuation-in-part of U.S. patent application Ser. No. 131,752 entitled "Combination Ballast and Cold Cathode Sealed Lamp and Method" filed on Dec. 11, 1987, which is a continuation-in-part of U.S. patent application Ser. No. 891,263 entitled "Self-Illuminated Sealed Cool Light Display and Method" filed on July 26, 1986, now U.S. Pat. No. 4,751,434.

BACKGROUND OF THE INVENTION (1) Field of the Invention

The invention is a retrofit sealed lighting device cassette for use in existing light housings, a unique powering unit for each cassette, a magnetic structure for use in the unit, combinations thereof, and methods.

(2) Prior Art

Many commercial area task lighting fixtures comprise a housing for the light and an openable door carrying a light diffuser element. The diffuser element is normally a thin plastic diffuser element embossed with a multiplicity of small lenses designed to scatter or concentrate the light.

The commercial light normally comprises a multiplicity of standard flourescent tubes, powered by one or more ballasts, in turn energized from a 120 volt main.

The prior art cold cathode systems consists of inefficient 60 cycle, high voltage generating core and coil sets. Our related prior art cold cathode systems employed 24 D.C. or A.C. and 10000 volts or more.

All prior art is characterized by low power factors.

SUMMARY OF THE INVENTION

The present invention preferably replaces the conventional flourescent tubes, ballast, diffuser and door frame and then utilizes the remaining housing as structural support. The device of the invention is thus termed a retrofit device.

The invention comprises a thin sealed light source, including an array of lightable tubing, an electronic power converter and sealed light enclosure within a door frame optimally, refletive means may be included within the housing behind the tubing.

In other embodiments of the invention, the cassette may omit either the door frame or the diffuser as either may be utilized in the existing installation, rather than recycled. This invention may also be utilized by original equipment manufactures of lighting fixtures as a ballast and light source in their product line.

Probably the most important advantage of the invention as a retrofit device is its ease of installation into an existing housing shell in order to produce approximately twice the lumen efficiency of the obsolete ballast and flourescent arrangement it replaces.

Another important advantage of the invention is the unique electronic high frequency power converter which energizes the retrofit device enabling it to double the lumen effeciency over the existing flourescent light fixtures that it replaces.

Another important advantage of the invention is the unique MULTI-DYNAMIC SMART MAGNETIC STRUCTURE which automatically fills in the voltage input wave sign as the AC dimmer eliminates portions of the voltage while maintaining a high power factor and not creating undesirable electromagnetic interference and noise.

The most important advantage of the invention including the power converter coupled with the new magnetic structure, is its ability to replace up to 5 billion existing inefficient lights with such costs being recoverable through energy-saving in less than 2 years.

The electronic power converter(ballast) of the present invention is operable from 110, 220, 277 volt A.C. mains and is able to obtain extraordinary efficiency while applying less than 1000 volts to the lamp load. Our ballast is capable of delivering more than 1000 volts for different parameters(re) larger diameter cold cathode tubing, etc.

The MULTI-DYNAMIC SMART MAGNETIC STRUCTURE includes an isolation circuit between the final output winding and the switching windings to permit the load to be shorted without damage, and to prevent variances in the load from disturbing the switching functions. The isolation circuit also permits the elimination of otherwise required major components, such as capacitors, chokes, resistors and other semi-conductors because it controls the voltage and the current within the magnetics.

A separate A.C. input winding extends A.C. main voltage directly to the load to allow even current and voltage in the final output to the load in spite of the conventional dimmer removes portions of A.C. main voltage.

Synergistically, the use of the retrofit device with the electronic power converter, including the MULTI-DYNAMIC SMART MAGNETIC STRUCTURE, enables the same lumen output of the lamp load at one half the wattage required relative to the standard fluorescent ceiling fixture of the same size.

Of course, these described components may comprise an original lamp for ceiling or other installation.

DESCRIPTION OF THE PREFFERED EMBODIMENT

Figure 1:
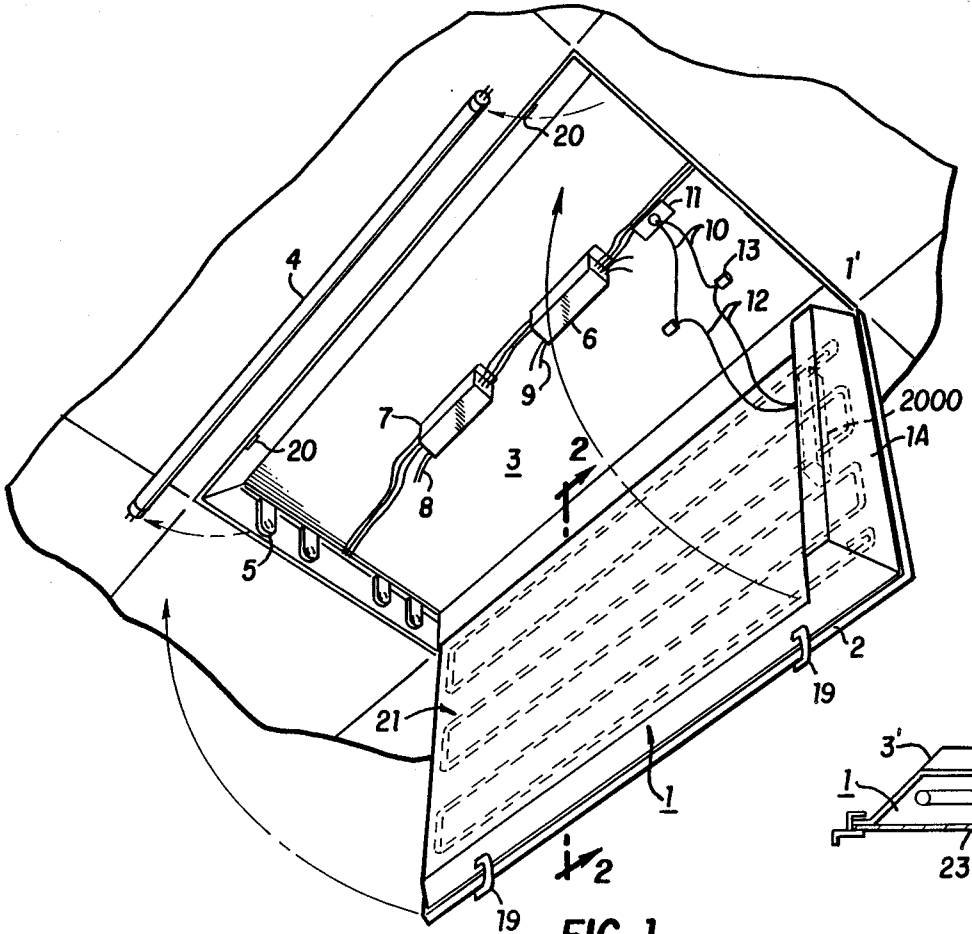
FIG. 1 shows the retrofit device invention relative to the existing housing in a perspective view.

FIG. 1 Shows the retrofit cassette 1 of the present invention in perspective, attached to a suitable complementary door frame 2 for closing fixed commercial light housing 3. The commercial housing 3 may measure 2'×2', 2'×4' or many other dimensions, and as found in most commercial buildings, functioning as ceiling lighting. In the United States alone over 1 billion such lighting fixtures are in existence. However, they employ standard flourescent tubes 4(FIG. 1) in 120 volt fixtures 5, in turn supported in a metal trough 3' determining the 2'×2', 2'×4' etc. dimension of the commercial light 3.

The conventional ballasts 6 and 7 are simply disconnected from the 120 volt main, as by cutting wires 8, 9, etc. and there are usually left in place because it costs money to dispose of these PCB containing devices. The trough 3' is perhaps 4¾" deep and the ballasts take up 1¾" of the trough space, but the thickness of cassette 1 is 2", over its principal length, and 3½" at the end 1. Thus, ample space is provided for receiving cassette 1 when the tubes 4 are removed because end 1 is disposed beyond ballast 6.

Cassette 1 is energized from the existing 120 volt wires 10, extending through U.L. approved plate 11. Wires 12 from the cassette 1 are connected to wires 10 in a conventional manner, as by wire nuts 13.

However, some slack is intentionally left in wires 10, 12 to permit installation and servicing when door frame 2 is opened (in hinge fashion) relative to commercial light 3.

(FIG. 1) Cassette 1 weighs about six pounds in the 2'×4' size with its aluminum enclosure 1A, accounting for approximately two pounds thereof. Thus, thinness and lightness of the cassette 1 allows its retrofit usage, and permits its support by the already present commercial fixture 3 via frame 2.

Figure 7:
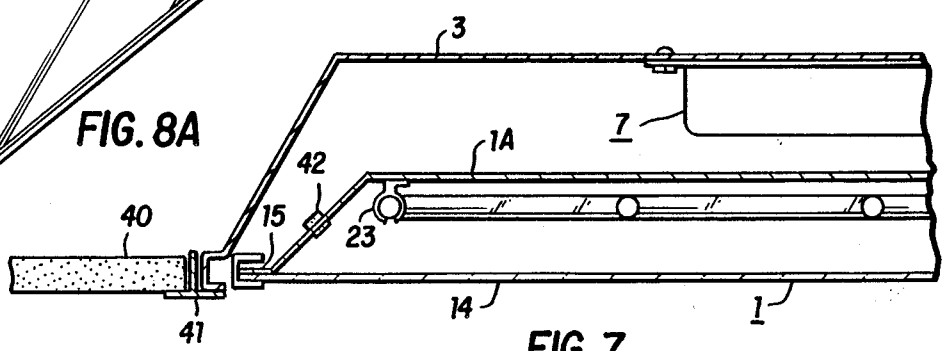
FIG. 7 shows a part of the retrofit housing to the fixed housing, in cross section.

The fixture 3 includes a frame, such as frame 2 and a diffuser, such as diffuser 14(FIG. 7).

These two parts may be cleaned and used in cassette 1 on site, but it is preferred that cassette 1 be factory sealed by diffuser 14 and assembled in door frame 2(FIG. 1), suitable for use in the type fixture 3 being retrofitted.

The cassette enclosure 1A (FIG. 2 and 7) includes peripheral flange 15 to which the peripheral edge of diffuser 14 is affixed to seal the cassette 1 against light depreciating airborn contaminates. Silicone glue, ultra sonic welding or other conventional means may be used to effect sealing.

Figure 2A:
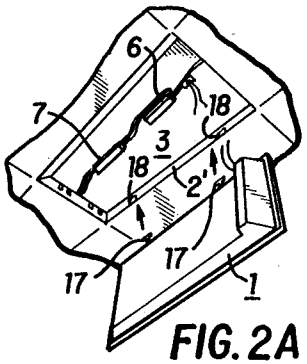
FIG. 2A is a detailed view to show one method of assembling the door with the cassette to the existing housing.
Figure 2:
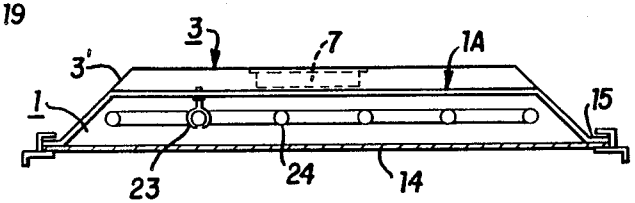
FIG. 2 is a cross sectional view of the invention, per se.

A frame 2 (FIG. 1) is conventionally carried by fixture 3 with the periphery of frame 2 conforming to and closely fitting within the periphery 2' of fixture 3 (FIG. 2A). The T hooks 17 (FIGS. 2A and 8A) fit into slots 18 (FIGS. 2A and 9) to form a "hinge".

Cassette 1 is then swung upwardly and latches 19 (FIG. 1) receive and engage slots 20 for locking.

Figure 3:
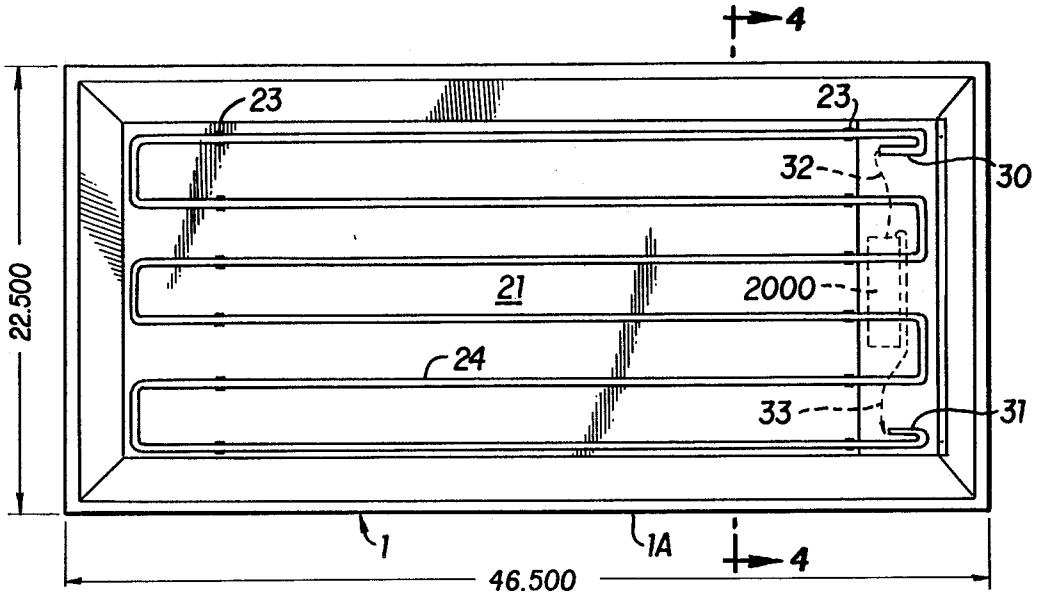
FIG. 3 is a top view of the cassette with the diffuser removed.

The lighting source for cassette 1 is the cold cathode tubing array 21. (FIGS. 1 & 3)

Everbrite, Inc. of Harbor City, California is one supplier of such cold cathode tubing in various shapes.

Commercially available pop rivetted flexible fasteners 23 (FIGS. 2 & 4) grip the tubing 24 and hold it spaced from the rear wall of retrofit enclosure 1A.

The electronic converter circuitry is contained in box 2000 (FIGS. 3 & 4) and is explained, infra.

Figure 4:
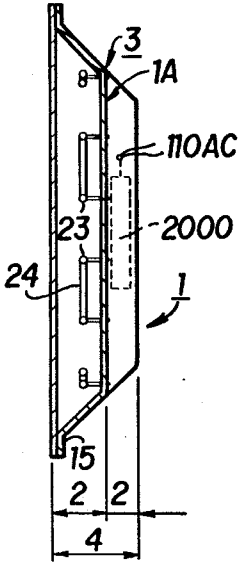
FIG. 4 is a sectional view taken from FIG. 3.
Figure 5:
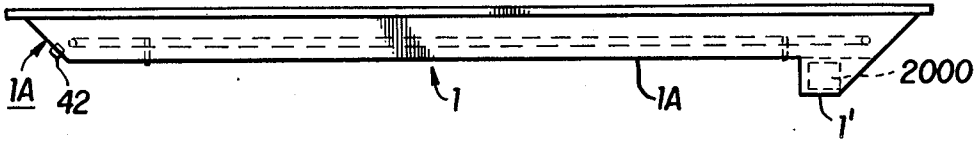
FIG. 5 is a view in side elevation of the cassette of FIG. 3.

FIGS. 3, 4, and 5 show the cassette 1, per se, without the diffuser 14, to a somewhat larger scale. The ends 30 and 31 of tubing 24 (FIG. 3) are shown respectively connected by wires 32, 33 to the high frequency powering electronic box 2000.

The optional reflector is not shown but it may comprise the polished aluminum interior of enclosure 1A or it may be a coating or actually a shaped sheet held to the interior wall by the pop up rivet fasteners 23.

Figure 6:
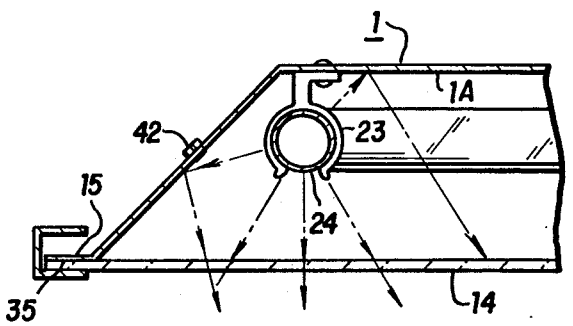
FIG. 6 is a partial sectional view of the cassette of FIG. 8 with the door frame of FIG. 8A shown assembled thereto.

FIG. 6 shows cassette 1 energized to emit light via diffuser 14. Diffuser 14 is glued to cassette flange 15 by RTV glue 35.

FIG. 7 shows the cassette housing 1A within the fixture 3, and the old unnecessary ballast is visible at 7. Ceiling tile 40 is shown with T bar 41 support between it and the lower edge of fixture 3. Pressure relief is obtained by particle or dust filter 42 (FIG. 7) which may comprise ceramic, or the like, of the diameter of a pencil or smaller. Thus, the sealed lamp unit simply means sealed from dust and the like, not air tight.

Figure 8A:
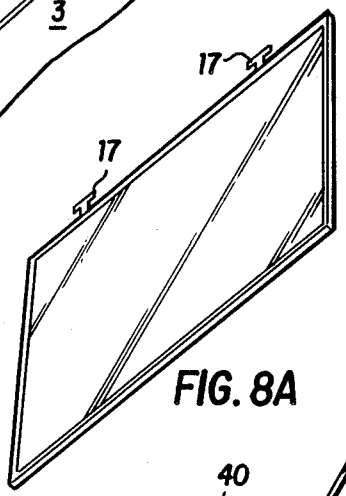
FIG. 8A is a door frame for the cassette of FIG. 8.
Figure 9:
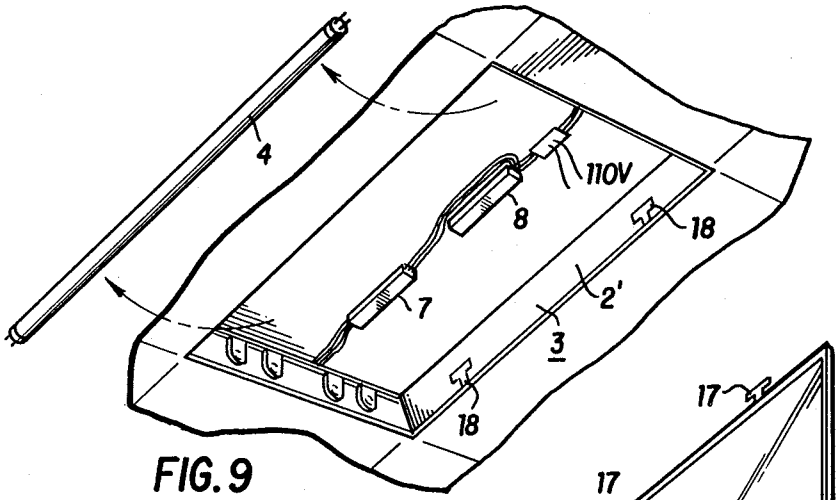
FIG. 9 shows the interior of the fixed housing for receiving the parts of FIGS. 8 and 8A.
Figure 8:
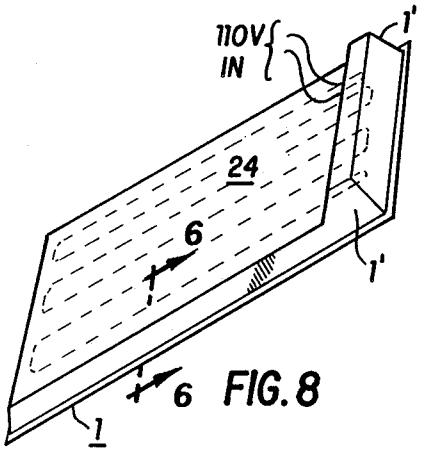
FIG. 8 is a perspective view of the cassette without a door frame.

FIGS. 8A and 9 show asssembly steps for using the retrofit cassette 1.

First, the door frame and the diffuser are removed from the commercial installation. Then, the wires from the AC mains to the ballasts are cut.

Next, the cassette 1 is hooked to the fixture 3 frame 2' in hinge fashion 17 to 18, as previously explained. The AC main wires are conventionally connected to the wires from the cassette power supply 1, and the door frame is hinged up and locked.

It may now be appreciated that the cassette door frame 2 is compatible to the previously existing lighting fixture housing 3' (FIG. 2), such that it may be received by the housing 3'.

Fastening means carried by the door frame 2 of the cassette 1 cooperate with the fastening means of the housing for receiving the new door frame. In other words, the cassette 1 of the present invention is manufactured to take advantage of whichever fastening scheme the manufacturer originally employed, or at least, the holes, slots or other fastening means already present in the housing. Mostly these are slots, openings, springs, pins, rods, bayonets, hooks or the like, (e.g.) simple fasteners.

The cassette of the present invention may also be utilized by prime manufacturers of the commercial fixtures to provide the primary light source as opposed to using standard flourescent tubes and ballasts.

The cassette enclosure 1A may be formed of light weight aluminum because the fixture housing 3' is of heavy gage metal to meet UL specifications in preserving the requisite fire wall. Also, it should be mentioned that the retrofit unit 1 may be removed at any time and the fixture restored to its original condition easily.

The powering unit including the MULTI-DYNAMIC SMART MAGNETIC STRUCTURE

Figure 10:
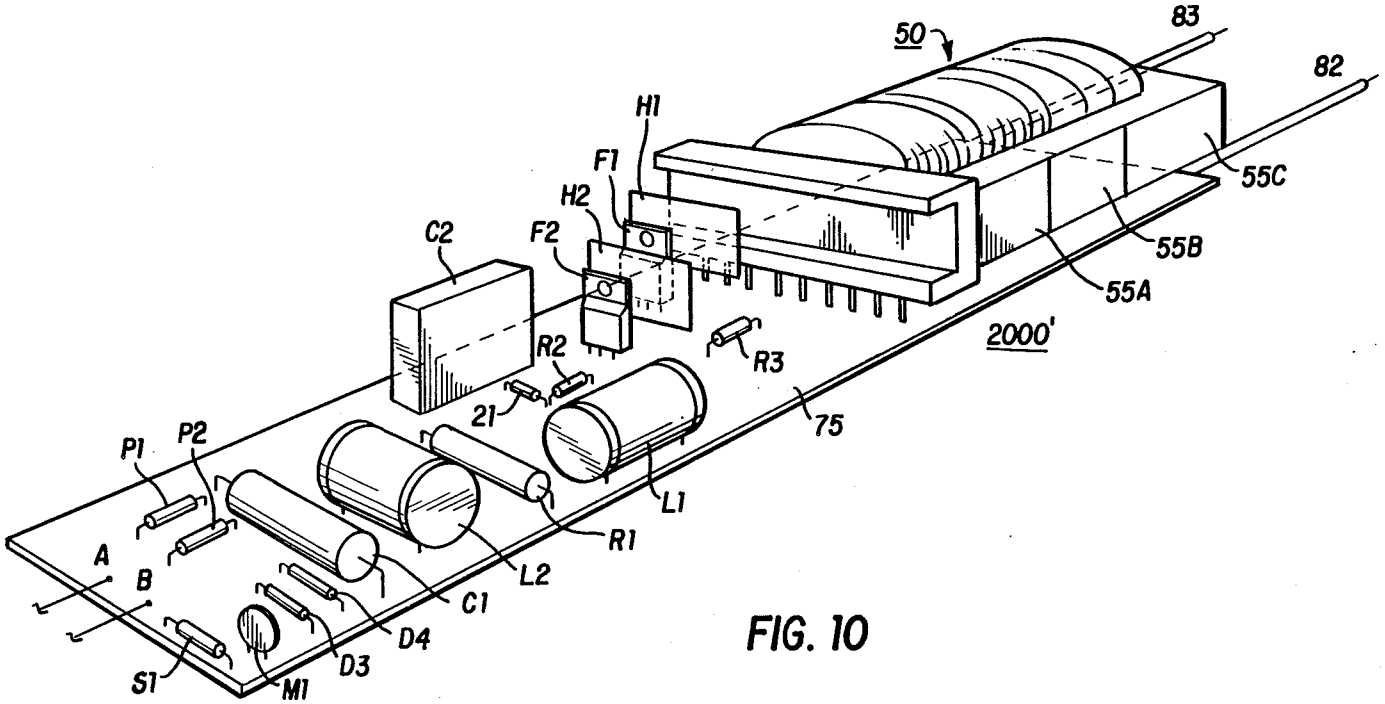
FIG. 10 is a view in perspective of the combined electronic and magnetic powering unit for a cold cathode load.
Figure 19:
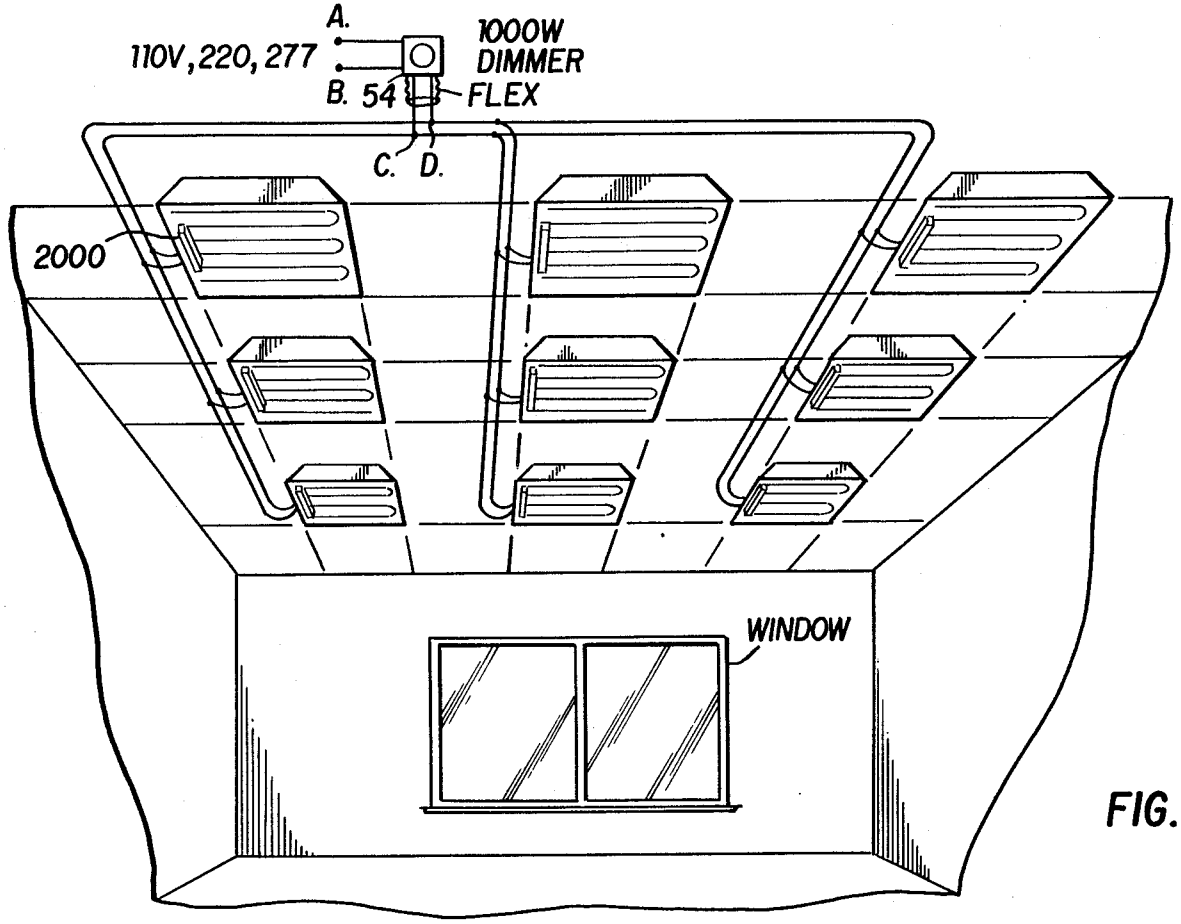
FIG. 19 is a view of a purality of 2'×2' lamps installed as a false ceiling.

In todays ballast market, high power factors are associated with a noisy ballast and you cannot utilize a light dimmer without major difficulties. The powering unit 2000(FIG. 1) comprises the MULTI-DYNAMIC SMART MAGNETIC STRUCTURE 50 (FIGS. 10 and 13), coupled to oscillating circuit 52 (FIG. 12) to make the ballast 2000' (FIG. 10) or 2000 (FIG. 1). The present invention is able to utilize a light dimmer 54 (FIG. 19) with the ballast 2000 easily from the A.C. mains terminals A,B (FIG. 11) without extra wiring and still maintain a 0.94 of unity power factor or better, without noise.

One major problem with todays ballasts is the toxic waste disposal needs of the ballast because of P.C.B. escaping from the tar, which the manufacturer uses as potting material in the structure contained in its ballast to act as a thermo-conductor plus a noise supressor within the ballast. We do not need to encapsulate the MULTI-DYNAMIC SMART MAGNETIC STRUCTURE, per se, or the ballast, nor does the combination ballast require encapsulation. We do not have the noise creation, nor the heat creation so potting is not needed to supress these factors. Thus, our ballast is environmentally safe with no inherent P.C.B.

The main dimming problems in todays ballast are:

1. Endeavoring to dim gas charged lamps with a standard dimmer without flickering, and 2. Effecting lowering of the A.C. voltage and current evenly, without chopping up the sine wave.

Figure 13:
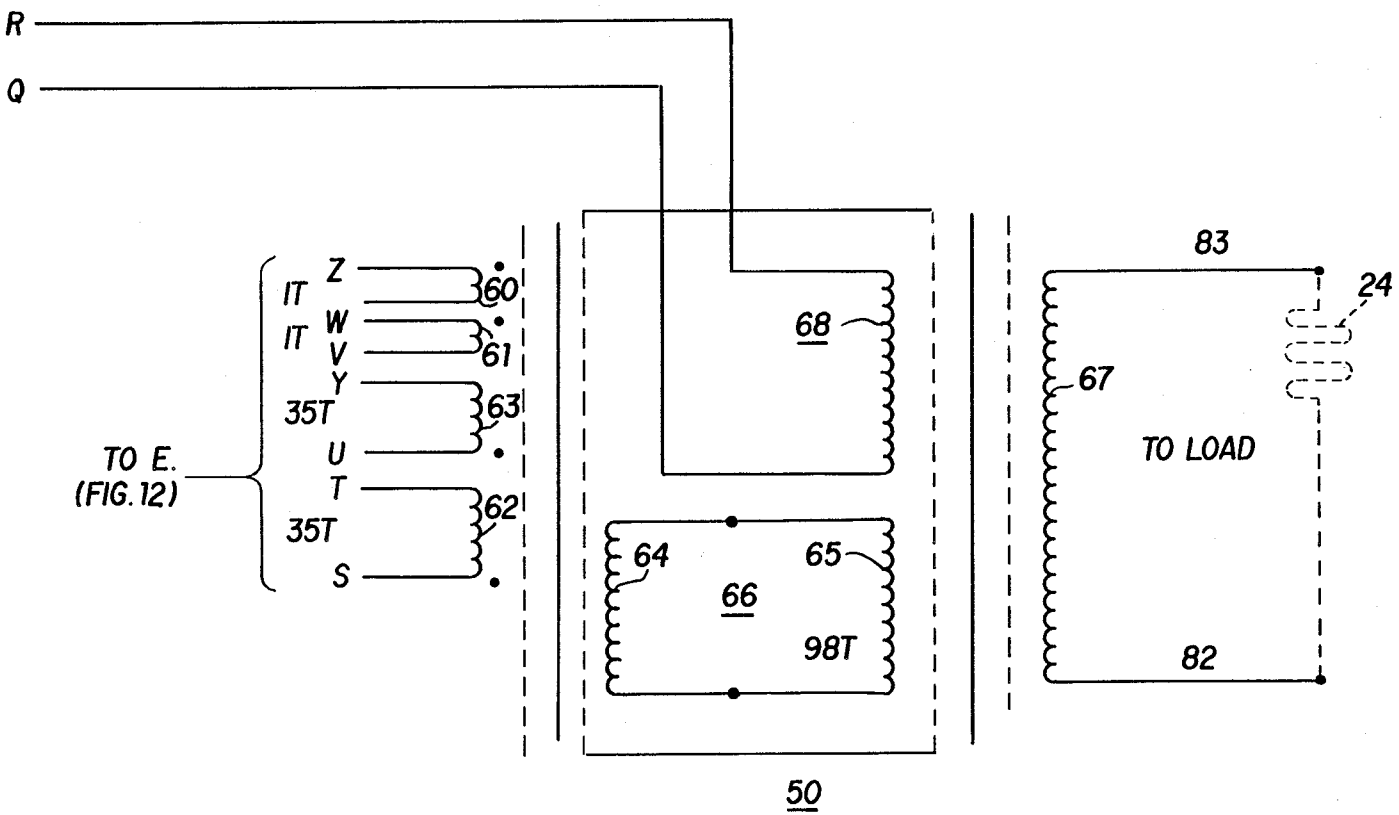
FIG. 13 shows the MUTI-DYNAMIC SMART MAGNETICS STRUCTURE, per se.

The way we achieve this in our MULTI-DYNAMIC SMART MAGNETIC STRUCTURE is:

(1) Preferably use 8 (FIG. 14) windings, 60, 61, 62, 63, 64, 65, 67, and 68, on a three section E core 55, being two sense windings 60, 61, two first primary circuit windings 62, 63, a first secondary winding 64, and a second primary winding 65 (load supply) connected as a continous loop isolation circuit 66 (FIG. 13). The lamp load supplying output winding (second secondary 67) and a unique A.C. 60 cycle main line input winding 68 conclude the 8 windings.

Figure 12:
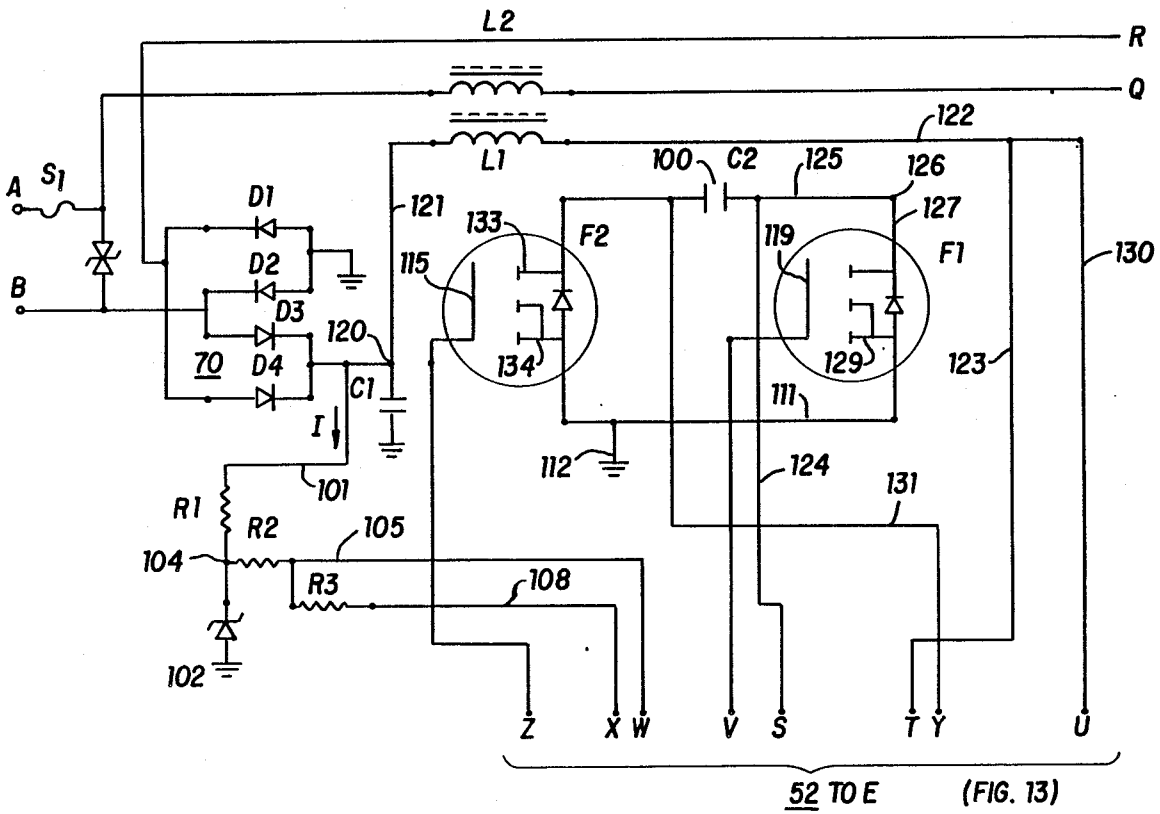
FIG. 12 is an electrical circuit diagram of a switching or oscillating section of the electronics or ballast.

A pair of switching FETs F1 and F2 (FIG. 12), a full wave rectifier 70, and isolated components comprise the oscillator circuit 52 (FIG. 12).

The oscillator section 52 (FIG. 12) drives the two first primaries 62, 63 (FIG. 13) on the MULTI-DYNAMIC SMART MAGNETIC STRUCTURE 50, allowing for the dimmer 54 (FIG. 19) to eliminate portions of current to permit to permit dimming of lamp array 24 the oscillator to run at 80 khz. The current 60 hz surges on the second primary winding 65 (FIG. 13) to fill in the lower missing portions of the voltage to smooth out the local voltage across terminal 67. Therefore, the circuit runs much smoother and quieter due to the non-fluctuation of the voltage and current in winding 67.

The current surge on the second primary winding 65 is accomplished through the unique A.C. 60 cycle main input winding 68 (FIG. 11) and occurs as a consequence of a disruption in the current flow such as the operation of dimmer 54. For example, if dimmer 54 reduces the current to the oscillator circuit 52 (FIG. 12) the current is reduced in isolation winding 65. If the unique A.C. 60 cycle main input winding 68 did not exist in the circuit, the voltage at winding 67 would be unstable and fluctuate due to the fact that dimmer 54 would remove portions of the current in the 60 hz sign wave of the A.C. main. The unstable condition at winding 67 would interrupt the operation of gas discharge lamp array 24 and result in flickering of the lamp. With the presence of the unique A.C. 60 cycle main input winding 68 (FIG. 11), when the dimmer 54 removes a portion of the current from the oscillator circuit 52, winding 68 compensates for the current that is lost due to the operation of the dimmer 54 thereby stabilizing the voltage and current delivery to winding 67. This results in a flicker-free gas discharge lamp.

Figure 14:
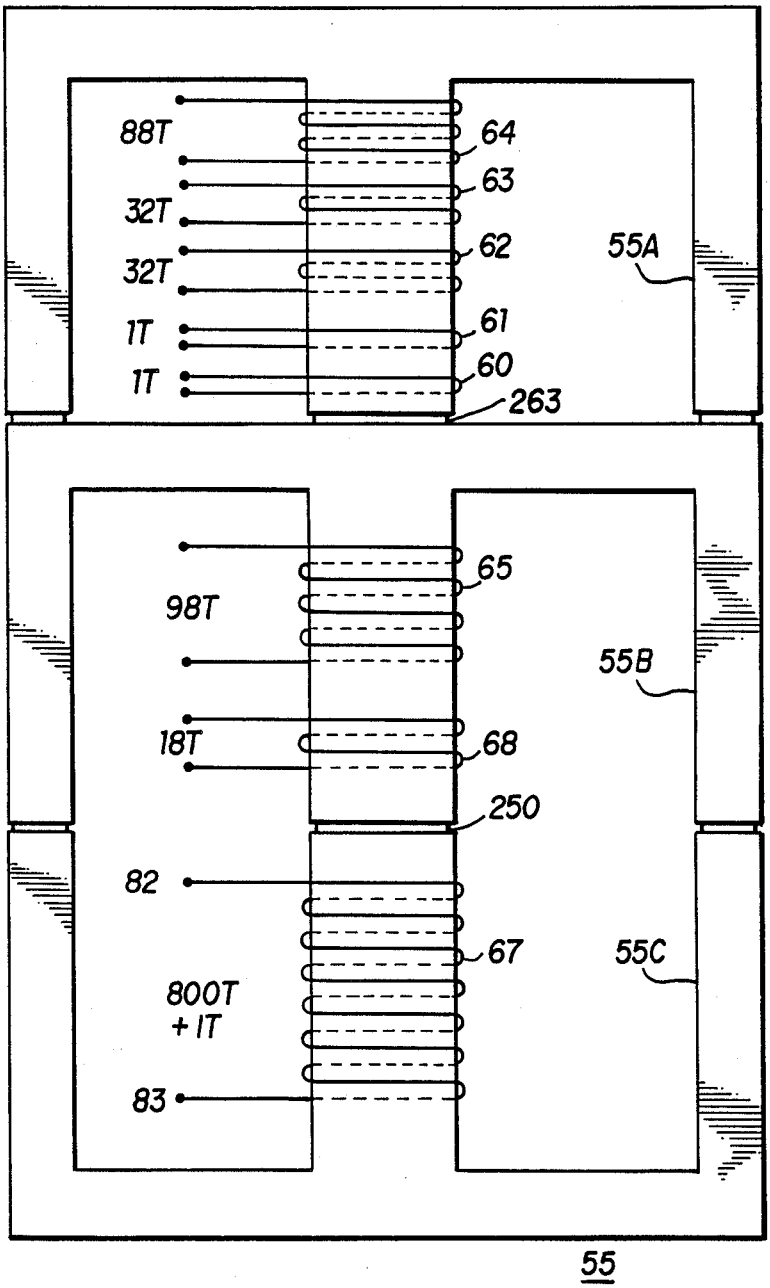
FIG. 14 shows the three section E core with all eight preferred windings.

The MULTI-DYNAMIC SMART MAGNETIC STRUCTURE 50, consists of two sensing windings 60, 61 of one turn each, two primary windings 62, 63 of 35 turns each. The first secondary winding 64 consists of 89 turns of Litz wire model 15/38 winding on a single core 55A (FIG. 14).

Figure 11:
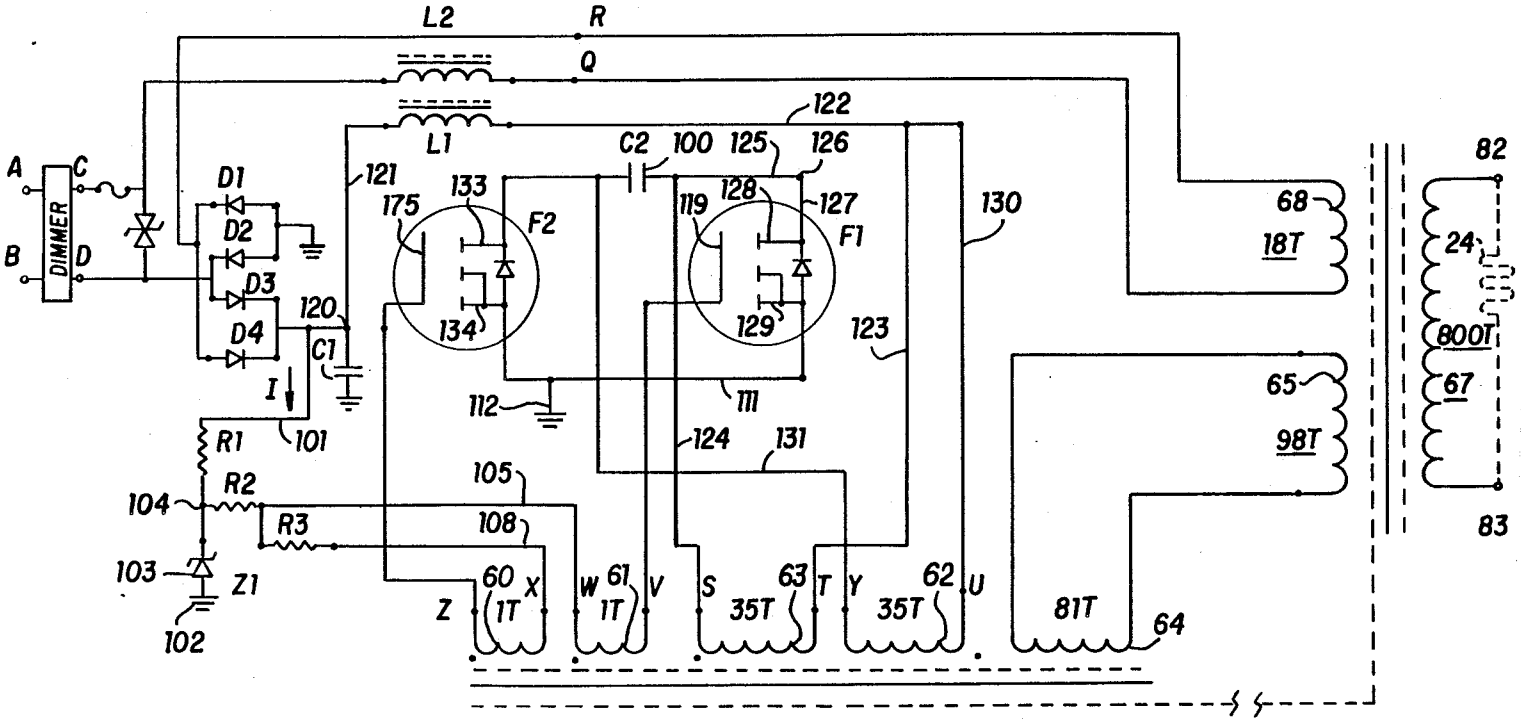
FIG. 11 is a schematic circuit of the ballast of FIG. 10.

The tighter the coupling of the primary 62, 63 to secondary 64, the greater the magnitude of induction of the oscillating into the load. The isolation circuit 66 (FIG. 11) substantially diminishes any load originated variences induced into core section 55A (FIG. 14), thus minimizing any effect at sense windings 60, 61. Thus, a steady output frequency is produced by F1 and F2 (FIG. 11). The isolation of core 55A (FIG. 14), within its own winding structure and isolated core permits the sense windings 60, 61 to track their respective primary windings 62, 63, hence intelligent or smart adaptation.

The second section of the MULTI-DYNAMIC SMART MAGNETIC STRUCTURE 50 (FIG. 13) is the second primary winding 65 with 98 turns. This winding is connected directly to the first secondary winding 64, and these two windings 65, 64 will control the voltage and current output to the lamp 24. Windings 65 and 68 are on core section 55B (FIG. 14) of common core 55,. On the same core section 55B, is the 18 turns, of 24A A.W.G. copper wire of windings that will supply any needed current voltage to keep the lamp evenly lit while dimming.

The final winding 67, on the same core section 55C, is the second secondary winding 67 which is a 36 A.W.G. wire with 800 turns on a custom made three section bobbin 80 (FIGS. 17A, 17B, and 18), this winding supplying the final output voltage and current for driving the lamp load 24 (FIG. 13).

The power unit 2000 (FIG. 3) will sense a dead short in the second secondary winding 67 (FIG. 13) and only draw 5 watts, or it will sense an open circuit, and only draw 5 watts due to inherent losses.

In general, the high frequency power supply 2000 (FIG. 3) of the present invention is the current sensing MULTI-DYNAMIC SMART MAGNETIC STRUCTURE 50 (FIG. 13) which energizes from 4 to 30 feet of cold cathode tubing 24 feet coupled to the low component count electronic oscillator circuit 52 (FIG. 12). This circuit may be powered by 120, 220 or 277 volts A.C. at 50–60 HZ. The MULTI-DYNAMIC SMART MAGNETICS STRUCTURE 50 (FIG. 13) also may be powered by D.C. mains for standby applications or D.C. mains only for space or military use, or the like.

The MULTI-DYNAMIC SMART MAGNETICS STRUCTURE 50 may operate satisfactory with no load or a shorted load. The unit will also run at, for example, 80 khz at 950 volts at a 0.94 of unity or better power factor.

OPERATION

The circuit of FIG. 11 is capable of driving a cold cathode 12 mm. neon lamp equivalent to the Voltarc 4500 kelvin white. A.C., SUCH AS THE LAMP ARRAY 21 OF (FIG. 3) A.C. mains supply input voltage to terminals A and B (FIG. 11).

The starting mode of operation proceeds from the time the A.C. input power is applied across terminals A and B of the lamp load tubing array 24 between secondary terminals 82 and 83 which load presents a very high resistance to the high frequency output of winding 65. The resistance of lamp load 24 drops to set the current value in winding 67, depending on the lamp load applied to the circuit i.e. the lenth of tubing, the tubing diameter, the temperature within the tube, the type of gas etc.

The rectified current I (FIG. 11), from rectifier 70, flows along conductor 101 to ground 102. Resistor R1 of 9 k ohms and zener 103 comprises a voltage divider with 3.9 volts D.C. appearing at junction 104. Resistor R2 (100 ohms) reduces current to the sense winding 61 (FIGS. 11 or 13). Resistor R3 (15 ohms) is connected in sense lead 108 to reduce the current to sense winding to 60 via terminals X (FIGS. 12, 13). Resistor R3 (15 ohms) (FIGS. 11, 12) prevents the sensing circuits from turning on at the same magnitude of voltage or current. This prevents the FETs F1 and F2 from turning on at the same time during startup and causing too much current through L1 and opening the fuse S1. Resistor R3 decreases the current enough in lead 108, relative to lead 105, to allow F1 to always turn on first during startup, i.e. the moment power is applied to terminals A and B.

Now that sense voltage has been supplied to windings 60 and 61 (FIGS. 11,13), the gates 115 and 119 of FETs F1 and F2 receive voltage of almost 3.9 volts via windings 60 and 61 (FIG. 11). Since they turn on at +2.5 volts, the one (61) receiving higher voltage will turn on. This is true because lead 111 is grounded at 112, and the DC circuit extends from rectifier 70, via junction 120 and lead 121, through inductor L1, along leads 122, 123, winding 63 and leads 124, 125, point 126 and drain lead 127. Current flows between drain 128 and source 129.

First primary winding 63 is wound opposite(see dots) to its sense winding 61, such that the pulse from FET F1 going on charging C2 to oppose the sense winding 61 of first primary winding 63, causing the gate voltage of F1 to approach zero volts, opening F1.

Sense winding 61 is now below DC ground so sense winding 60 can turn on FET 2 by its gate 115.

A current path exists from point 120, leads 121, L1, 122, 130, second primary winding 62, lead 131 to other side of C2 and via drain 133 FET 2, and source 134 to ground 112.

Sense winding 60 is now below DC ground, so sense winding 61 turns on FET 1.

Windings 63 and 62 are the two primary windings which are wound oppositly (See dots FIG. 11). When F1 and F2 are switching, these two windings form a sinusoidal waveform is at winding 64.

Figure 17B:
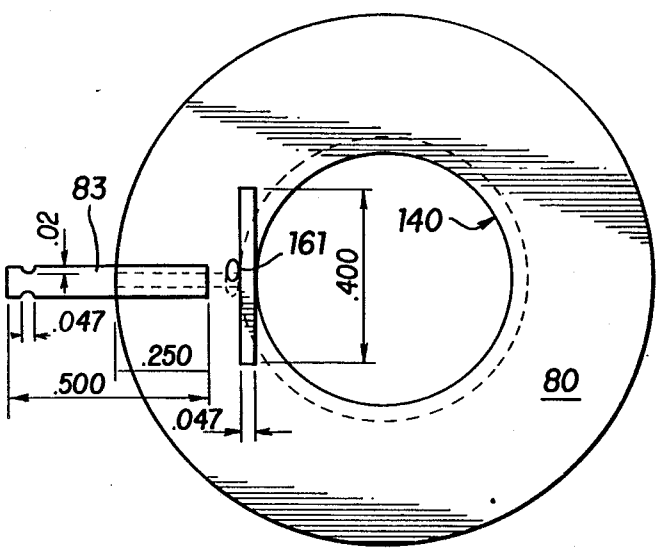
FIG. 17B is a view in side elevation of the bobbin of FIG. 17A.
Figure 17C:
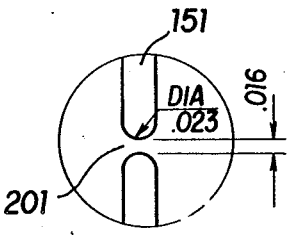
FIG. 17C is a detailed view of the center crossover slot of the bobbin of FIG. 17A.

FIG. 17 shows the unique bobbin 80 used in this invention to hold the second secondary winding 67 and isolate it from transient voltage breakdown. The bobbin 80 is made of DUPONT Rynite which allows for dielectric strength of 600 volts per/mil.

Figure 17A:
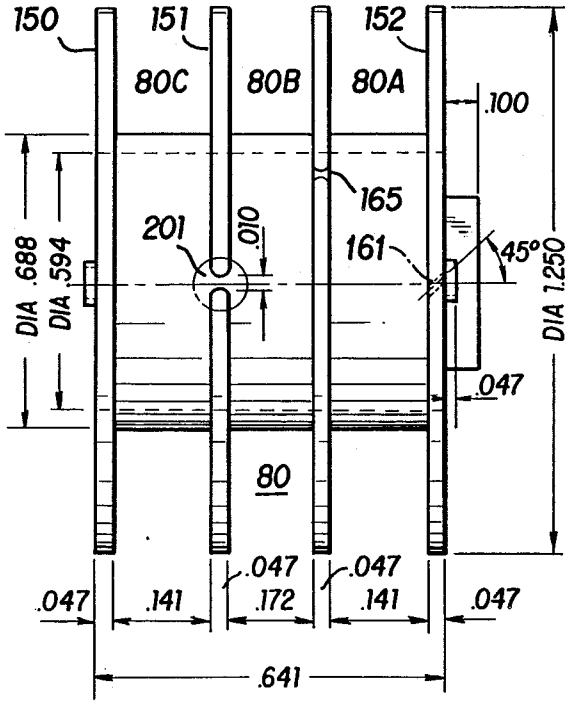
FIG. 17A Shows a front view of the second secondary bobbin.

In FIG. 17A the bobbin 80 has three sections, 80A, 80B and 80C, start section 80A, a cross-over section 80B, and a finish section 80 C. The O.D. of the bobbin 80 is 1.250 and the core 140 of bobbin 80 is 0.594". The core bobbin winding area has a diameter of 0.688" the wall thickness is 0.047" on all walls, the start hole 161 (FIG. 17A) is a 45 degree downward penetrating opening of 0.016" diameter and the center cross-over spacing or slot 80B has a width of 0.172", while the width of sections 80A and 80C are 0.0142" and the width of the spaces (e.g.) 150, 151 and 152 are each 0.047".

Figure 16:
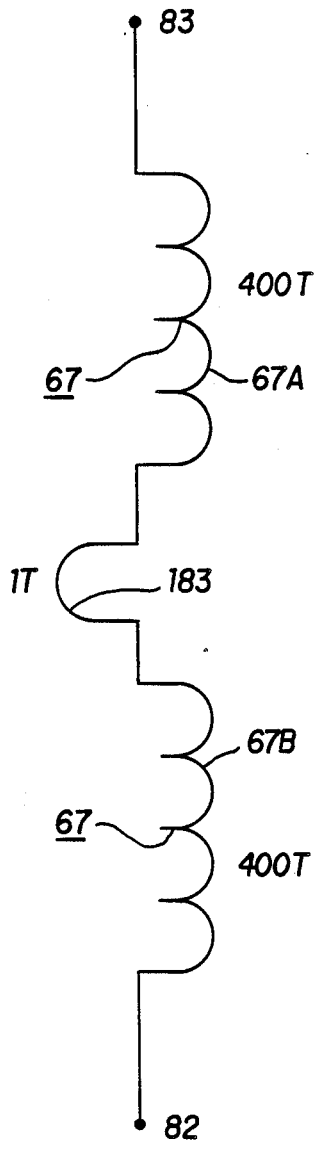
FIG. 16 shows the second secondary output winding for a lamp load with bobbin crossover.
Figure 18:
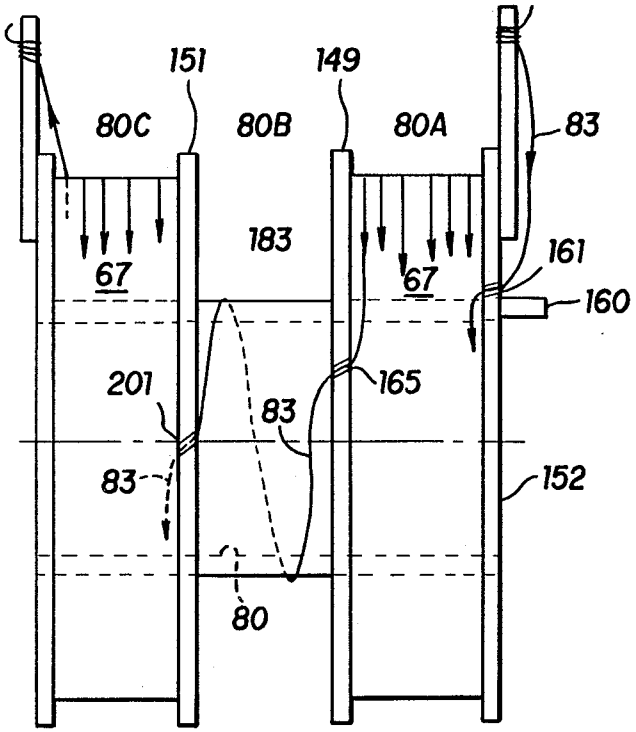
FIG. 18 is a view of the bobbin of FIG. 17A showing the manner of winding the second secondary output winding.

Looking at FIG. 17A, 17B and 18, the winding wire 83 enters the start hole 161 and proceeds in a counter clockwise direction about the spool 80A for one half of the winding 67A (FIG. 16). In the structure of FIG. 17A and 18, the cross-over slot 165 is shown guiding the wire 83 of the second secondary winding 67. The cross-over turn is shown at 183 (FIG. 18) of section 80B, this one turn 183 enters the cross-over section 80B via peripheral notch 165 in spacer 149 and is turned to encircle the core 140 (FIG. 17B) in section 80B for one turn 183, splitting the secondary winding 67 (FIG. 16) into two equal halves.

Once the crossover turn 183 penetrates opening 201, wire 83 is wound in the same direction on bobbin section 80C as the first half was wound on bobbin section 80A.

Figure 15A:
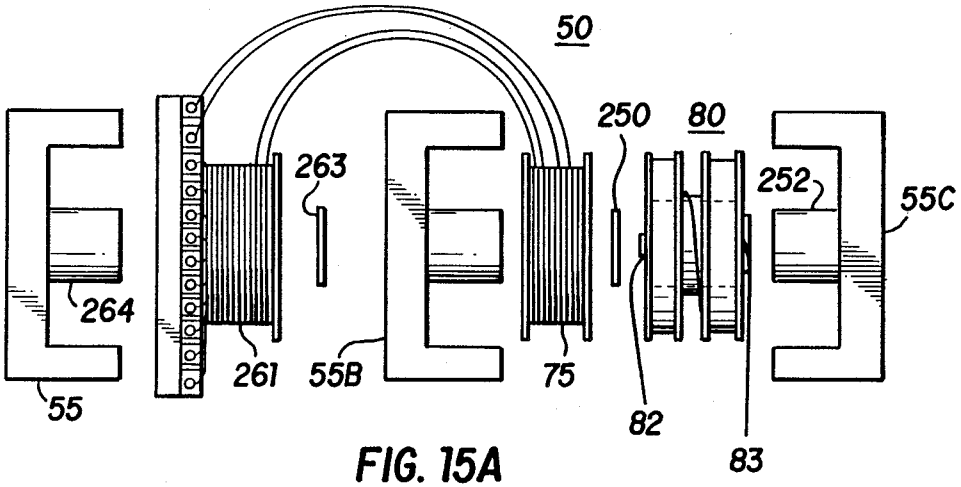
FIG. 15A is an exploded view of the E core, bobbins, and windings.
Figure 15B:
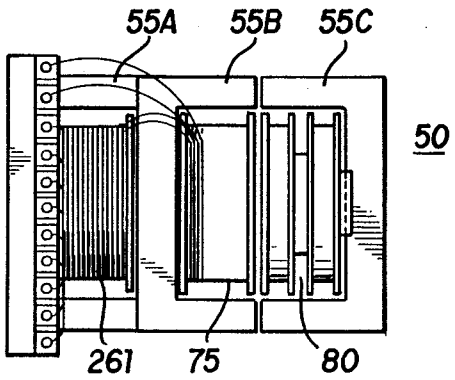
FIG. 15B shows the components of FIG. 15A assembled in operative relation.

Winding 67 is shown on bobbin 80 in FIGS. 15A and 15B for mounting on righthand E core section 55C. Windings 68 and 65 are carried by conventional bobbin 75, in turn mounted on E section 55B. Conventional spacer 250 gap separates middle legs 251–252 of sections 55B and 55C when assembled. The outside legs are separated by glue in conventional fashion.

(FIG. 11) E core section 55A carries 8 pin bobbin connector 260 and a conventional bobbin 261 including 5 windings, 60, 61, 63, 62, 64.

(FIG. 15A) Spacer 263 separates E core middle leg 264 of section 55A from the back of section 55B.

Note that this assembly requires no potting, nor special insulation, is light weight and does not heat up unduly.

The MUTI-DYNAMIC MAGNETIC STRUCTURE 50 may be installed in any asymetrical switching oscillating electronic circuit. The preferred circuit we designed herein described for MULTI-DYNAMIC SMART MAGNETICS appears optimally efficient for its intended purpose.

Typical values of the components of switching circuit are as follows:

L1 600 M.H.
L2 250 M.H.
RESISTOR R1 5 WATT 9 K OHM
RESISTOR R2 ¼ WATT 100 OHM
RESISTOR R3 ¼ WATT 15 OHM
ZENER ¼ WATT 3.9 V
DIODE 1.5 AMP 200 V
DIODE 1.5 AMP 200 V
DIODE 1.5 AMP 200 V
DIODE 1.5 AMP 200 V
FILM CAP 5.0 MFD. 200 VOLT
FILM CAP 4700 P.F. 2000 VOLT
ETD 39 FERRITE CORE—3 SECTIONS
8 PIN BOBBIN CONNECTOR TAILORED TO FIT ETD 39 CORE

WINDINGS 62, 63, 64, 65 LITZ WIRE
M.O.V. 2 AMP 170 VOLT
FUSE 3 AMP. 200 VOLT
F.E.T SSP4N70
F.E.T SSP4N70
HEAT SINKS H2 H1 5700 AAVID

These parts are valued for the 120 volt oscillator.

It may now be appreciated that the MULTI-DYNAMIC SMART MAGNETICS 50 with a two F.E.T asymetrical 80 KHZ oscillator complete with dimming capabilities and a high power factor may be used as the most efficent means for powering the CASSETTE light. The oscillator we designed around the MULTI-DYNAMIC SMART MAGNETICS 50 (FIG. 13) has only a minimal number of componets which means there are fewer chances of part to part breakdown in the circuit. We found that coupling this circuit and the MULTI-DYNAMIC SMART MAGNETICS 50 with the CASSETTE light permitted us to acheive at least 50% greater overall efficencies and with the simple dimming of the lightable tubing, efficiencies can be even greater.

A master dimming control may be employed to control a plurality of lights, manually or by photo sensing.

What is claimed is:

1. A power converter operable from a relatively low frequency A.C. main to develop a relatively high frequency oscillatory power source to supply a cold cathode lamp load, comprising in combination:

an oscillator section means having a pair of FETs interconnected to develop said oscillatory power from the A.C. main;

isolation means for applying said oscillating power to said lamp load; and, an A.C. circuit connected to said A.C. main for supplying low frequency voltage to said load to even out the high frequency oscillatory power applied to said load.

2. The power converter of claim 1, wherein:

said oscillator section means comprises four windings on a first core section;

said A.C. circuit comprises a further winding on a second core section;

said isolation means comprises an additional winding on said first core section and an additional winding on said second core section; and said lamp load comprises a winding on a third core section for receiving energy from said A.C. circuit and said means for applying oscillating power to said lamp load.

3. The method of employing eight windings disposed selectively on three core sections to apply 60 cycle energy and high frequency energy to a cold cathode lamp load, comprising in combination:

using a first pair of said windings to switch a pair of FETs to produce said high frequency;

using a second pair of said windings to produce approximately an 80 kilohertz high frequency for application to said lamp load;

as isolation circuit comprising a further pair of said windings to control the voltage and current to an output winding on a second core section for said lamp load; and, using an A.C. winding on a third core section at 60 cycles to fill in the voltage applied to said lamp load whenever dimming consumes a portion of the 60 cycle energy; and, said isolation circuit including an eighth winding on said third core section.

4. The power converter of claim 2 wherein:

the windings of said isolation means are connected in parallel.

5. The power converter of claim 4, wherein:

two of said four windings of said oscillator section means on said first core section comprise sense windings for said FETS.

6. The power converter of claim 5, wherein:

two more of said four windings of said oscillator section means on said first core section comprise first primary windings on said first core section for transferring drive energy to the isolation circuit.

7. The power converter of claim 6, wherein:

each of said two first primary windings and said windings of said isolation means comprise litz wire.

* * * * *